United States Patent [19]

Davis

[11] 4,303,845

[45] Dec. 1, 1981

[54] THERMIONIC ELECTRIC CONVERTER

[76] Inventor: Edwin D. Davis, 330 N. Clyde Morris Blvd., Daytona Beach, Fla. 32014

[21] Appl. No.: 33,025

[22] Filed: Apr. 24, 1979

[51] Int. Cl.[3] ..... H01J 45/00

[52] U.S. Cl. ..... 310/306

[58] Field of Search ..... 310/306, 11

[56] References Cited

U.S. PATENT DOCUMENTS

| | | | |
|---|---|---|---|
| 2,915,652 | 12/1959 | Hatsopoulos et al. | 310/306 |
| 3,041,481 | 6/1962 | Peters, Jr. et al. | 310/306 |
| 3,118,107 | 1/1964 | Gabor | 310/306 X |
| 3,133,212 | 5/1964 | Szekely | 310/306 |
| 3,267,307 | 8/1966 | Fox | 310/306 |
| 3,328,611 | 6/1967 | Davis | 310/306 |
| 3,393,330 | 7/1968 | Vary | 310/306 |
| 3,477,012 | 11/1969 | Laing | 310/306 X |
| 3,519,854 | 7/1970 | Davis | 310/306 |

*Primary Examiner*—Donovan F. Duggan

*Attorney, Agent, or Firm*—Kerkam, Stowell, Kondracki & Clarke

[57] ABSTRACT

A thermionic electric converter is disclosed wherein an externally located heat source causes electrons to be boiled off an electron emissive surface interiorly positioned on one end wall of an evacuated cylindrical chamber. The electrons are electrically focused and accelerated through the interior of an air core induction coil located within a transverse magnetic field, and subsequently are collected on the other end wall of the chamber functioning as a collecting plate. The EMF generated in the induction coil by action of the transiting electron stream interacting with the transverse magnetic field is applied to an external circuit to perform work, thereby implementing a direct heat energy to electrical energy conversion.

11 Claims, 4 Drawing Figures

THERMIONIC ELECTRIC CONVERTER

BACKGROUND OF THE INVENTION

1. Field of the Invention

The present invention relates generally to the field of converting heat energy directly to electrical energy, and more particularly to apparatus having a thermionic source of electrons, which electrons subsequently produce currents in an induction coil for energizing externally connected loads.

2. Description of the Prior Art

Heretofore, there have been known thermionic converters such as shown in U.S. Pat. Nos. 3,519,854 and 3,328,611 (both to the inventor of the present invention) which disclose apparatus and methods for the direct conversion of thermal energy to electrical energy. In U.S. Pat. No. 3,519,854 there is described a converter using a Hall effect techniques as the output current collection means. The U.S. Pat. No. 3,519,854 teaching is of interest in that it uses as its source of electrons a stream boiled off of an emissive cathode surface and accelerated towards an anode positioned beyond the Hall effect transducer. In U.S. Pat. No. 3,328,611, a spherically configured thermionic converter is disclosed wherein a spherical, emissive cathode is supplied with heat (from several alternate sources including a self-contained fuel combustion section) thereby emitting electrons to a concentrically positioned, spherical anode under the influence of a control member having a high positive potential thereon.

While the above two illustrative examples of prior art thermionic converters teach apparatus for accomplishing the desired direct conversions, and while a good deal of additional inventive effort has been directed to the practical and theoretical problems associated with such conversion means, it is clear that there continues to be a need for improved devices and methods for direct thermal/electric converters.

SUMMARY OF THE INVENTION

The Thermionic Electric Converter of the present invention implements a technique for the direct conversion of heat energy to electrical energy by using a stream of electrons thermally released from an electron emissive cathode, and accelerated by a static electric field to transit through the center of a pick up coil immersed in a strong magnetic field, thereby producing an induced EMF. The heat energy may be derived from any source whatever, and the induced EMF is directly used to power electrical loads.

It is therefore a primary object of this invention to provide improved apparatus for directly converting heat energy to electrical energy.

A further object of the present invention is to provide improved apparatus for changing heat energy to an electrical current without passing through the conventional mechanical steps of operating a generator to produce an electrical current.

A further object of the present invention is to provide apparatus for converting heat energy into electrical energy using the thermally released electrons from an electron emissive material to execute an interactive path within a stationary magnetic field thereby inducing an EMF within a coil useable to energize electrical loads.

A still further object of the present invention is to provide apparatus for converting heat energy to electrical energy wherein any convenient source of heat, such as heat obtained from the combustion of fossil fuels or recovered from existing atomic operations, and the like, may be used to provide the required electron liberation energy.

BRIEF DESCRIPTION OF THE DRAWINGS

These and other features of the present thermionic electric converter and the attendant advantages will be readily apparent to those having ordinary skill in the art, and the invention will be more easily understood from the following detailed description of the preferred embodiments of the present invention taken in conjunction with the accompanying drawings wherein like reference characters represent like parts throughout the several views.

DETAILED DESCRIPTION OF THE PREFERRED EMBODIMENT

Figure 1:
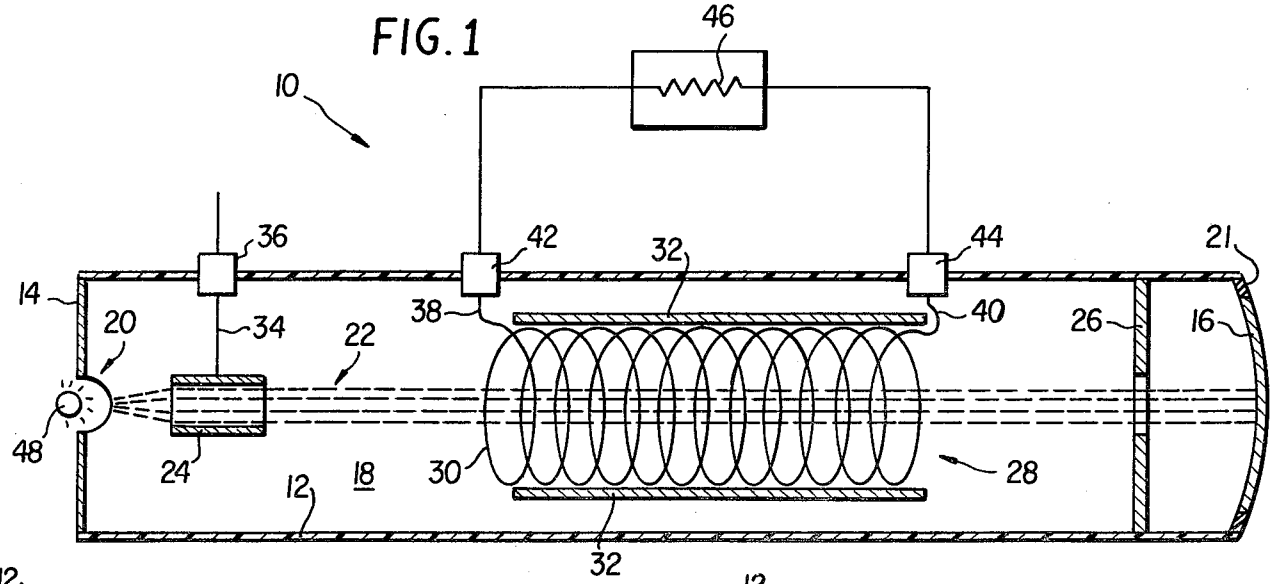
FIG. 1 is schematic side view of the Thermionic Electric Converter according to the present invention.

Referring now to FIG. 1, there is shown a schematic side view of a Thermionic Electric Converter according to the present invention. The converter is shown generally at 10 having an elongated, cylindrically shaped outer housing 12 fitted with a pair of end walls 14 and 16, thereby forming a closed chamber 18. The housing 12 is made of any one of a number of known strong, electrically non-conductive materials such as high temperature plastics or ceramics, while the end walls 14 and 16 are metallic plates to which electrical connections may be made. The three elements are mechanically bonded together and hermetically sealed such that the chamber 18 may support a vacuum, and a moderately high electrical potential may be applied and maintained across the end walls 14 and 16. The first end wall 14 contains a shaped cathode region 20 having an electron emissive coating (not shown) disposed on its interior surface, while the second end wall 16 is formed as a circular, slightly convex surface which is first mounted in an insulating ring 21 to form an assembly, all of which is then mated to the housing 12. In use, the end walls 14 and 16 function respectively as the cathode terminal and the collecting plate of the converter 10. Between these two walls an electron stream 22 will flow substantially along the axis of symmetry of the cylindrical chamber 18, originating at the cathode region 20 and terminating at the collecting plate 16.

An annular focusing element 24 is concentrically positioned within the chamber 18 at a location adjacent to the cathode 20. A baffle element 26 is concentrically positioned within the chamber 18 at a location adjacent to the collecting plate 16.

Figure 2:
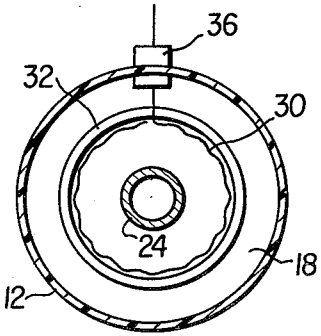
FIG. 2 is schematic end view of the converter.

Disposed between these two elements is an induction assembly 28 comprised of a helical induction coil 30 and an elongated annular magnet 32. The coil 30 and the magnet 32 are concentrically disposed within, and occupy the central region of, the chamber 18. Referring briefly to the schematic end view of FIG. 2, the relative radial positioning of the various elements and assemblies may be seen. For clarity of presentation, the mechanical retaining means for these interiorly located elements have not been included in either figure. Focusing element 24 is electrically connected by means of a lead 34 and a hermetically sealed feed through 36 to an external source of static potential (not shown). The induction coil 30 is similarly connected via a pair of leads 38 and 40 and a pair of feed throughs 42 and 44 to an external load element shown simply as a resistor 46.

The potentials applied to the various elements are not explicitly shown nor discussed in detail as they constitute well known and conventional means for implementing related electron stream devices. Briefly, considering (conventionally) the cathode region 20 as a voltage reference level, a high positive voltage is applied to the collecting plate 16 and the external circuit containing this voltage source is completed by connection of its negative side to the cathode 20. This applied high positive voltage causes the electron stream 22 which originated at the cathode region 20 to be accelerated towards the collecting plate 16 with a magnitude directly dependent upon the magnitude of the high voltage applied. The electrons impinge upon the collecting plate 16 at a velocity sufficient to cause a certain amount of ricochet. The baffle element 26 is configured and positioned to prevent these ricochet electrons from reaching the main section of the converter, and electrical connections (not shown) are applied thereto as required. A positive voltage of low to moderate level is applied to the focusing element 24 for focusing the electron stream 22 into a narrow beam.

In operation, a heat source 48 (which could be derived from diverse soources such as combustion of fossil fuels, solar devices, atomic, atomic waste or heat exchangers from existing atomic operations) is used to heat the electron emissive coating on the cathode 20 thereby boiling off quantities of electrons. The released electrons are focused into a narrow beam by focusing element 24 and are accelerated towards the collecting plate 16. While transiting the induction assembly 28, the electrons come under the influence of the magnetic field produced by the magnet 32 and execute an interactive motion which causes an EMF to be induced in the turns of the induction coil 30. Actually, this induced EMF is the sum of a large number of individual electrons executing small circular current loops thereby developing a correspondingly large number of minute EMFs in each winding of the coil 30. Taken as a whole, the output voltage of the converter is proportional to the velocity of the electrons in transit, and the output current is dependent on the size and temperature of the electron source. The mechanism for the induced EMF may be explained in terms of the Lorentz force acting on an electron having an initial linear velocity as it enters a substantially uniform magnetic field orthogonally disposed to the electron velocity. In a properly configured device, a spiral electron path (not shown) results, which produces the desired net rate of change of flux as required by Faraday's law to produce an induced EMF. This spiral electron path results from a combination of the linear translational path (longitudinal) due to the acceleration action of collecting plate 16 and a circular path (transverse) due to the interaction of the initial electron velocity and the transverse magnetic field of magnet 32. Depending on the relative magnitude of the high voltage applied to the collecting plate 16 and the strength and orientation of the magnetic field produced by the magnet 32, other mechanisms for producing a voltage directly in the induction coil 30 may be possible. The mechanism outlined above is suggested as an illustrative one only, and is not considered as the only operating mode available. All mechanisms, however, would result from various combinations of the applicable Lorentz and Faraday considerations.

Figure 3B:
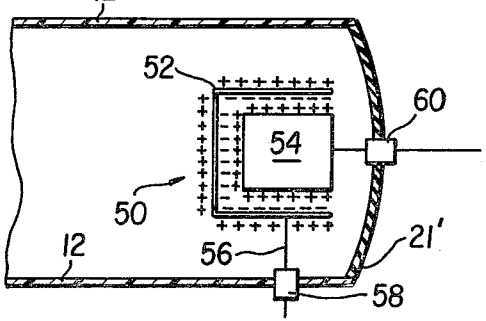
FIGS. 3A and 3B show alternate embodiments of collecting assemblies comprised of compound electrophorus elements.
Figure 3A:
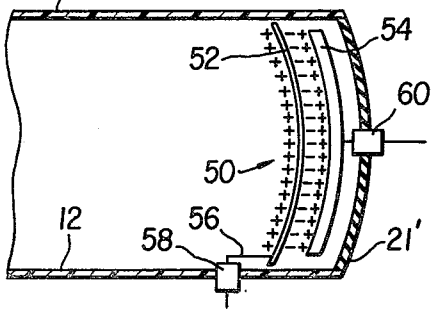

The collecting plate 16, which has been described as a single conductive element, may be configured as shown in FIGS. 3A and 3B. Referring to FIG. 3A, element 16 has been replaced with a compound collector 50, comprised of electrophorus collector elements 52 and 54. Collector element 52 is made of electrically conductive material, while collector element 54 is a non-conductor. Conductive element 52 is electrically connected to the external system circuitry via a lead 56, and a feed through 58 positioned in the outer casing 12. Non-conductive element 54 is similarly connected via a feed through 60 positioned in the extended insulated end wall 21'. In operation, element 54 is charged with a static charge of positive sign, which will induce a negative change on the adjacent side of element 52, and will cause a positive charge to be induced on the opposite side of element 52. The various charges are illustrated as linear distributions of appropriately polarity charges along their respective surfaces. The positive charge on element 52 will then act to attract the electrons being emitted from the cathode 20. Thus, the charge remains on element 52 as long as the charge remains on element 54, and the electrons never contact element 54. The electrons do not neutralize the positive charge on element 52 because they are constantly drained off through a grounding means (not shown) which may either feed the electrons to the neutral ground environment or may return them through external circuitry to the cathode 20. This would probably prevent rapid erosion of the cathode, thus lengthening the life of the converter.

FIG. 3B shows an alternate embodiment of the compound collector 50, which has a modified geometry but essentially functions as the embodiment of FIG. 3A. Note that the elements 52 and 54 are shaped so as to be nested together. As before, element 54 is charged with a positive sign, which induces a charge on the container-like element 52 which is negative on the inner surface and which induces a positive on the outer surface of the element 52. Once again, the attracted electrons are immediately drained off via the lead 56 and are returned to cathode 20 or system ground as appropriate.

Figure 4A:
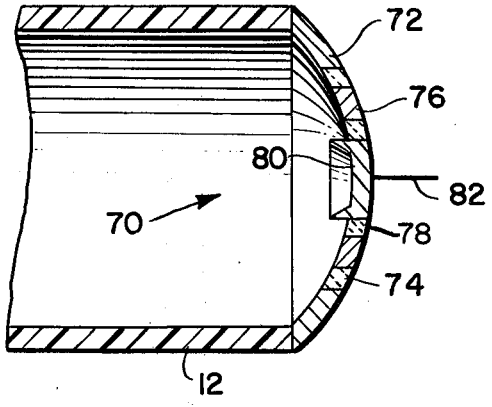
FIGS. 4A and 4B show a further alternate embodiment of a collecting plate mechanism.
Figure 4B:
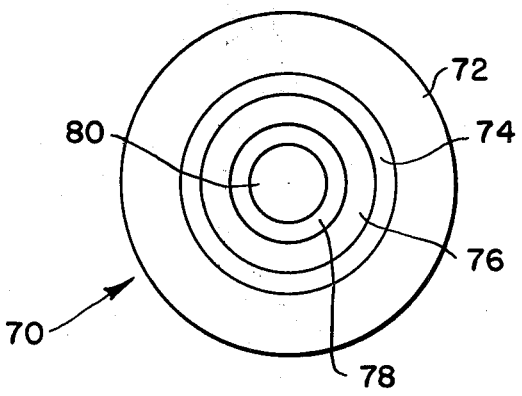

FIGS. 4A and 4B show a further alternate embodiment which may be employed in lieu of the collecting plate 16. Referring to partial side view 4A and end view 4B, element 16 has been replaced with collector plate mechanism 70 comprised of a number of concentric sections, all of which are shaped to produce a truncated hemispherical overall form. Collector mechanism is made of a general housing 72 which is bonded to the cylindrical outer housing 12. General housing 12 serves as the outermost ring, to the inner edge of which is bonded an insulation ring 74. A heavily statically charged ring 76 is next bonded to the insulation ring 74. An inter-collecting element consisting of an insulating ring 78 is next bonded into the collector plate mechanism 70, and finally a circular electron collecting element 80 provides the central area. The collecting element 80 is electrically connected to the external system circuitry via a lead 82. In operation, a heavy static charge is applied to the charged ring 76 (via a lead not shown), which ring would then serve as the attracting force for the electron stream. Thereafter system operation is substantially as detailed above, except for the need, under certain operating conditions, for additional electron focusing in the region between the induction coil 30 and the collecting plate. This additional electron focusing is readily accomplished by the insertion of an additional focusing element, similar to that of element 24 of FIG. 1, which would control electron scatter.

While in the basic embodiment described it is apparent that an AC output voltage is produced, a variety of adjunct conversion means may be used to provide the output electrical energy in almost any desired form. An internal mechanism for providing the output energy in alternate forms is available by dividing the induction coil 30 into a number of individual coils. The output from each of the individual coils may then be used to energize separate external loads, or may be combined in various ways to optimize the available output voltages, currents, and power, as well as to minimize output power ripple. Clearly, as the induction coil 30 serves to produce incrementally induced voltages throughout substantially all of its length, any subsection thereof may also be considered as a discrete source of electrical energy and may be used accordingly.

Although the invention has been described in terms of selected preferred and illustrative embodiments, the invention should not be deemed limited thereto, since other embodiments and modifications will readily occur to one skilled in the art. For example, the magnet 32 described as being a permanent magnet may readily be replaced by an electromagnet. Further, a portion of the electrical energy produced by the converter may be used in part to supply the electrical needs of the converter itself. It is therefore, to be understood that the appended claims are intended to cover all such modifications as fall within the true spirit and scope of the invention.

What is claimed is:

1. Apparatus for converting heat energy directly into electrical energy comprising:

(a) a cathode element having an electron emissive surface for emitting electrons in response to the application of heat energy to said surface;

(b) a collecting element maintained at a positive electrical potential with respect to said cathode element for attracting, accelerating and collecting said electrons;

(c) an induction assembly comprised of a helical coil having a longitudinal axis and means for producing a stationary transversely oriented magnetic field in the interior region of said coil;

(d) an evacuated elongated container for fixedly housing said cathode element at a first end, and said collecting element at a second end, and said induction assembly at an intermediate location therein;

(e) whereby said emitted electrons in accelerated transit towards said collecting element are caused to pass through said coil interior region therein individually exhibiting a minute oscillatory magnetic field action thus giving rise to an induced EMF in said coil.

2. The apparatus of claim 1 wherein said helical coil is comprised of a plurality of separate coil sections, which coil sections are electrically interconnected to optimize the output power of said converter.

3. The apparatus of claim 1 wherein said helical coil is comprised of a plurality of separate coil sections, which coil sections are electrically interconnected to minimize the output ripple of said EMF.

4. The apparatus of claim 1 wherein said means for producing said magnetic field comprises a permanent magnet.

5. The apparatus of claim 1 wherein said means for producing said magnetic field comprises an electromagnet.

6. The apparatus of claim 5 wherein said electromagnet is energized at least in part by said induced EMF.

7. The apparatus of claim 1 wherein said container is cylindrically shaped and has first and second end walls, with said cathode element disposed interiorly on said first end wall, and said collector element constituting said second end wall, and said induction assembly positioned concentrically and centrally within said container.

8. The apparatus of claim 7 further comprising means for focusing said emitted and accelerated electrons into a narrow beam prior to their entering said induction assembly.

9. The apparatus of claim 8 wherein said magnetic field producing means is formed in the shape of an elongated annulus and has said helical coil longitudinally nested therein.

10. The apparatus of claim 9 wherein said collecting element further comprises a conductive element and a non-conducting element associated with electrophorus materials so as to support interactive charge distributions on said conductive and non-conductive elements.

11. The apparatus of claim 8 wherein said collecting element further comprises a multipart element having at least two insulating ring parts which separate at least two electrically conductive parts, and further comprises a second means for focusing said electrons positioned to focus said electrons subsequently to their leaving said induction assembly.

* * * * *